United States Patent [19]

Abo

[11] 4,407,259

[45] Oct. 4, 1983

[54] PLASMA IGNITION SYSTEM FOR AN INTERNAL COMBUSTION ENGINE

[75] Inventor: Toshimi Abo, Yokohama, Japan

[73] Assignee: Nissan Motor Company, Limited, Yokohama, Japan

[21] Appl. No.: 333,748

[22] Filed: Dec. 23, 1981

[30] Foreign Application Priority Data

Jan. 8, 1981 [JP] Japan ..... 56-764

[51] Int. Cl.[3] ..... F02P 3/08

[52] U.S. Cl. ..... 123/620; 123/621; 123/638; 123/654; 123/655

[58] Field of Search ..... 123/143 B, 598, 605, 123/620, 621, 622, 638, 640, 654, 656, 655

[56] References Cited

U.S. PATENT DOCUMENTS

| | | | |
|---|---|---|---|
| 4,122,816 | 10/1978 | Fitzgerald et al. | 123/143 B X |
| 4,136,301 | 1/1979 | Shimojo et al. | 123/598 X |
| 4,223,656 | 9/1980 | Hamley | 123/620 X |
| 4,317,068 | 2/1982 | Ward et al. | 123/654 X |
| 4,361,129 | 11/1982 | Sugie et al. | 123/622 |
| 4,369,756 | 1/1983 | Ezoe | 123/179 BG X |

FOREIGN PATENT DOCUMENTS 3015609 10/1980 Fed. Rep. of Germany .

3015611 10/1980 Fed. Rep. of Germany .

*Primary Examiner*—Tony M. Argenbright

*Attorney, Agent, or Firm*—Schwartz, Jeffery, Schwaab, Mack, Blumenthal & Koch

[57] ABSTRACT

A plasma ignition system having a plurality of plasma ignition plugs eliminates a mechanical distributor for sequentially distributing plasma ignition energy into each plasma ignition plug. The plasma ignition system comprises: (a) a high DC voltage surge generator for generating and outputting a high DC voltage surge to one of the plasma ignition plugs to be ignited so as to develop a spark discharge due to dielectric breakdown; (b) a plasma ignition energy generator such as a voltage booster for boosting a low DC voltage; (c) a capacitor for storing the plasma ignition energy generated by the plasma ignition energy generator; (d) a plurality of rectifiers each connected to either end of the capacitor and one of the plasma ignition plugs; a means for generating and outputting a trigger signal at every ignition timing; and (e) a pair of electrical switching elements, each connected between either end of the capacitor and ground, for grounding either end of said capacitor when the trigger signal generated at every ignition timing is received.

16 Claims, 7 Drawing Figures

PLASMA IGNITION SYSTEM FOR AN INTERNAL COMBUSTION ENGINE

BACKGROUND OF THE INVENTION

1. Field of the Invention

The present invention relates generally to a plasma ignition system having a plasma ignition plug within each combustion chamber of an internal combustion engine, and more particularly to a plasma ignition system which does not require a mechanical distributor for applying a plasma ignition energy sequencially to one of a plurality of engine cylinders.

2. Description of the Prior Art

A conventional plasma ignition system comprises a DC power supply such as a vehicle battery, an ignition coil having a primary winding and a secondary winding, an interrupter connected to the ignition coil which opens and closes in synchronization with engine revolutions and a plurality of plasma ignition plugs, each mounted in a cylinder. The conventional system further utilizes a distributor having a drive shaft with a breaker cam and an advance mechanism. A breaker plate is provided with contact points, a capacitor for absorbing an arc generated as any one of the contacts is reopened, and a rotor, a drive shaft attached to the rotor driven by the engine camshaft through spiral gears, rotating at one-half crankshaft speed. The contact points open or close according to the rotation of the drive shaft and breaker cam, and the breaker cam rotates at half the crankshaft speed. The contact points, thus, close and open once for each cylinder with every breaker-cam rotation. Further, there is provided a first diode connected to the secondary winding of the ignition coil and to the rotor of the distributor; a second diode, connected to the rotor of the distributor; a current suppressing coil connected to the cathode terminal of the second diode; a voltage booster, connected to the plus polarity of the DC power supply; and a capacitor, connected to the output terminal of the voltage booster and to the coil.

In the conventional plasma ignition system described above, immediately after the interrupter opens, the secondary winding of the ignition coil provides a high-voltage surge for the rotor of the distributor via the first diode so that the insulation resistance between the central electrode and ground electrode of one of the plasma ignition plugs is reduced due to the dielectric breakdown within the discharge gap of the plasma ignition plug. At this time, an electric charge within the capacitor is discharged at the plasma ignition plug described above via the coil and second diode. Due to such high energy, a gas within the discharge gap is injected through the injection hole in the form of plasma gas to carry out the plasma ignition. However, there is a drawback in such conventional plasma ignition system, wherein the distributor described hereinafter is susceptible to suffer a trouble since the rotor is brought into a slidable contact with one of the contact points.

SUMMARY OF THE INVENTION

With the above-described drawback in mind, it is an object of the present invention to provide a plasma ignition system wherein the distributor of the construction described above is eliminated so as to reduce the mechanical failure associated therewith.

According to the present invention, this is achieved by the plasma ignition system which comprises:

(a) a floating charge means which charges one end of a plasma ignition capacitor to a plus polarity of a DC power supply and the other end thereof to a minus polarity of the DC power supply;

(b) a spark discharge means which performs a simultaneous spark discharge at a timing of ignition by electrically connecting either end of a secondary winding of the plasma ignition coil to one end of one of plasma ignition plugs;

(c) switching means, inserted between the plus polarity end and minus polarity end of the capacitor, which selectively turns on to ground either end of the capacitor; and (d) a connection circuit which connects each end of the plus polarity and minus polarity of the capacitor to each non-ground terminal of the plasma ignition plugs via each of two reverse-blocking diodes.

BRIEF DESCRIPTION OF THE DRAWINGS

The features and advantages of the plasma ignition system for an internal combustion engine will be more clearly appreciated from the following description taken in conjunction with the accompanying drawings where the same reference numerals denote corresponding elements and in which.

DETAILED DESCRIPTION OF THE PREFERRED EMBODIMENTS

Reference will be made to the drawings and first FIG. 1 which shows a conventional plasma ignition system for a four-cylinder internal combustion engine.

Figure 1:
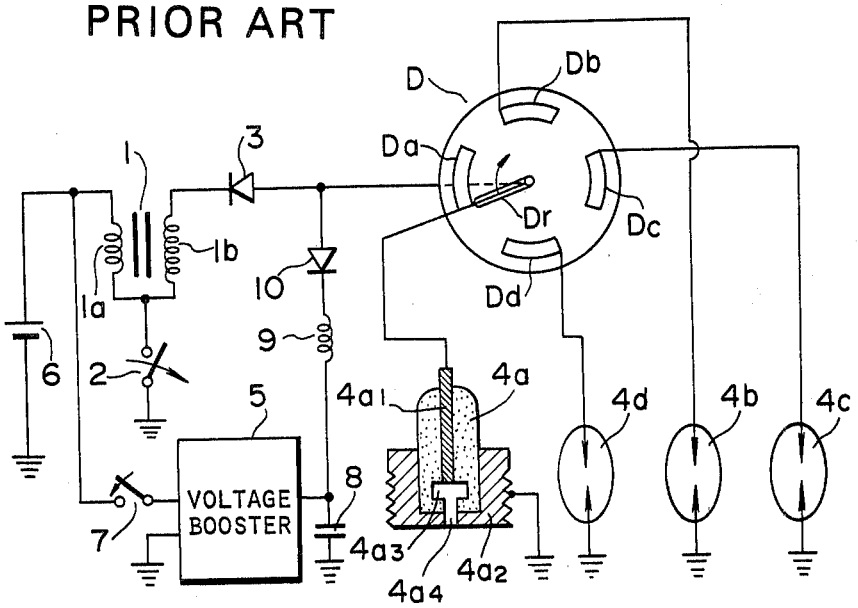
FIG.1 PRIOR ART
FIG. 1 is a circuit diagram showing a conventional plasma ignition system using a distributor.

In FIG. 1, numeral 1 denotes an ignition coil having an iron core around which primary winding 1*a* and secondary winding 1*b* are attached, the number of turns in the secondary winding 1*b* being greater than that of the primary winding 1*a*. Numeral 2 denotes a mechanical interrupter which opens instantaneously whenever an engine camshaft performs one rotation. The engine camshaft speed is twice that of a crankshaft. Numeral 3 denotes a first diode. Numeral 4*a* denotes one of plasma ignition plugs, having a central electrode rod 4*a* at a center thereof and a ground electrode $4a_2$ at a peripheral portion thereof, a discharge gap $4a_3$ provided at an insulating member between the central electrode $4a_1$ and ground electrode $4a_2$, and injection hole $4a_4$ provided at a bottom center of the ground electrode $4a_2$ for injecting a plasma gas generated at the discharge gap $4a_3$. Numeral 5 denotes a voltage booster, e.g., DC-DC converter which boosts a low DC voltage to a high DC voltage of about minus 3000 V. Numeral 6 denotes a DC power supply connected to the primary winding 1*a* of the ignition coil 1 and to the voltage booster 5 via a switch 7. Numeral 8 denotes a capacitor connected between the output terminal of the voltage booster 5 and ground. Numeral 9 denotes a current suppressing coil connected to the capacitor. Numeral 10 denotes a second diode having a cathode terminal connected to the current suppressing coil 9 and an anode terminal connected to the anode terminal of the second diode 10. Symbol D denotes a distributor including a rotor Dr which rotates at one half the crankshaft speed and a plurality of contact points Da through Dd, each of the contact points Da through Dd being connected to corresponding one of the plasma ignition plugs 4*a* through 4*d*.

Immediately after the contact point of the interrupter 2 opens, the secondary winding 1*b* of the ignition coil 1 generates a high negative voltage of about 10 to 20 KV.

The high voltage thus generated is applied to a central electrode $4a_1$ of the ignition plug 4*a* via the first diode 3, the rotor Dr of the distributor D, and contact point Da thereof. Consequently, the dielectric breakdown between the central electrode $4a_1$ and ground electrode $4a_2$ occurs and a spark discharge is generated within the discharge gap $4a_3$. On the other hand, the voltage booster 5 receives a low DC power supply via the switch 7 and generates a negative output voltage of about 3000 V so that the capacitor 8 is charged. When the insulation resistance is reduced due to the dielectric breakdown, the charge within the capacitor 8 is fed across the plasma ignition plug 4*a* via the current limiting coil 9 and second diode 10. The high energy thus fed to the plasma ignition plug 4*a* causes the gas within the discharge gap $4a_3$ to be injected through the injection hole $4a_4$ in the form of plasma, thereby carrying out plasma ignition.

Figure 2:
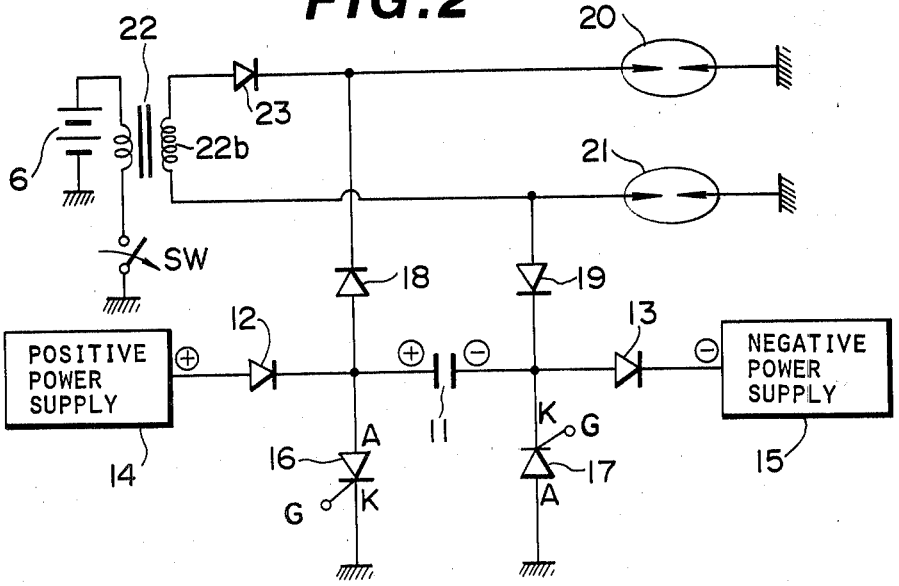
FIG. 2 is a circuit diagram showing a plasma ignition system according to the present invention for explaining its principle of operation.

FIG. 2 shows a new plasma ignition system for explaining its principle of operation to introduce the present invention.

In FIG. 2, numeral 11 denotes a plasma ignition capacitor which charges in a floating mode (terminals not grounded) via a first rectifier 12 and second rectifier 13. Each terminal of the plasma ignition capacitor 11 is grounded via one of two reverse blocking triode thyristors (referred hereinafter simply to as thyristors). In other words, the positive terminal of the plasma ignition capacitor 11 is connected to a positive DC power supply 14 via the first rectifier 12, and the negative terminal of the capacitor 11 is connected to a minus DC power supply 15 via the second rectifier 13.

Furthermore, the positive terminal of the capacitor 11 is connected to one of two plasma ignition plugs 20 via a diode 18, and the negative terminal of the capacitor 11 is connected to the remaining plasma ignition plug 21 via another diode 19. It will be noted in this case that the plasma ignition plugs 20 and 21 are mounted within the same cylinder as a pair of ignition plugs of a plurality of engine cylinders.

One end of a secondary winding 22*b* of the plasma ignition coil 22 is connected to the plasma ignition plug 20 via another diode 23 and the other end thereof is connected to the plasma ignition plug 21, so that each plasma ignition plug 20 and 21 generates a spark discharge at the same ignition timing. At this time, a current flows from the central electrode to the ground electrode in the plasma ignition plug 20.

For example, when the plasma ignition is started at the plasma ignition plug 20, the thyristor 17 needs to be turned on by the triggering of the gate electrode thereof. With the thyristor 17 turned on, a negative terminal of the capacitor 11 discharges to zero volt so that the positive voltage at the positive terminal of the capacitor 11 is applied to the ignition plug 20 via the diode 18. The electric charge of the capacitor 11 is sent via the thyristor 17, capacitor 11, and diode 18 to the ignition plug 20, thus carrying out plasma ignition in plug 20. The other plasma ignition plug 21 carries out plasma ignition by turning on the thyristor 16 with the thyristor 17 turned off.

Figure 3:
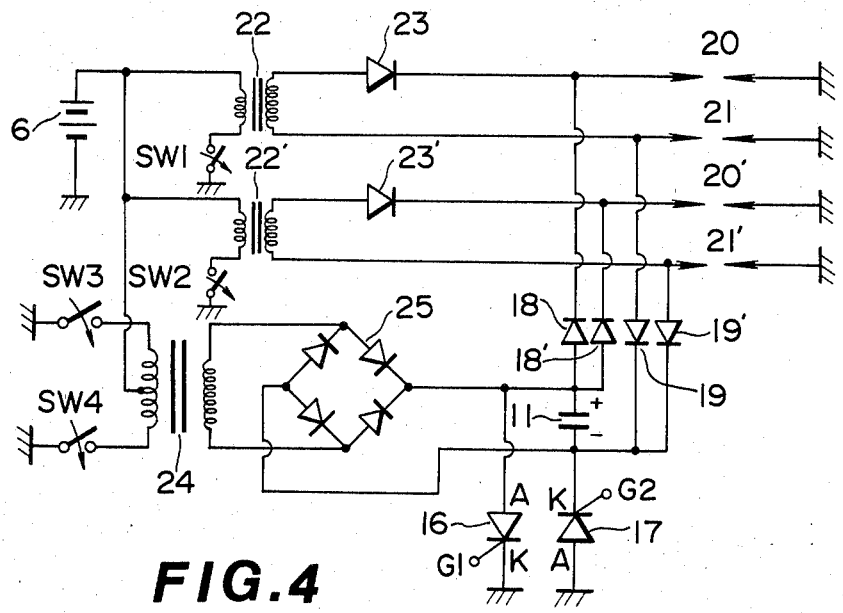
FIG. 3 is a circuit diagram showing a first preferred embodiment of the plasma ignition system according to the present invention.

FIG. 3 shows a first preferred embodiment of the plasma ignition system according to the present invention. The floating charge on the capacitor 11 is developed from a transformer 24 and full-wave rectifier 25. The DC voltage of the power supply 6 is applied to a primary winding center tap of a transformer 24 and converted by means of the primary winding of the transformer 24 and switching action of both switches SW3 and SW4 into an alternating-current voltage which then boosted by means of a secondary winding of the transformer 24 so that the AC voltage generated at the secondary winding thereof is rectified by means of the full wave rectifier 25 consisting of four bridged diodes. Both output ends of the full-wave rectifier 25 provide a high DC voltage for the positive and negative terminals of the capacitor 11. In the preferred embodiment shown in FIG. 3, there are two plasma ignition coils 22 and 22', both ends of the secondary winding of one plasma ignition coil 22' connected to the two plasma ignition plugs 20' and 21' via a diode 23' and both ends of the secondary winding of the other plasma ignition coil 22 connected to the two plasma ignition plugs 20 and 21 via another diode 23. The terminals of the capacitor 11 are in the floating state with respect to ground respectively via the thyristors 16 and 17. The positive terminal of the capacitor 11 is connected to the plasma ignition plug 20 via a diode 18 and to the plasma ignition plug 20' via another diode 18'. The negative terminal of the capacitor 11 is connected to the plasma ignition plug 21 and to the plasma ignition plug 21' via a diode 19 and another diode 19'.

Figure 5:
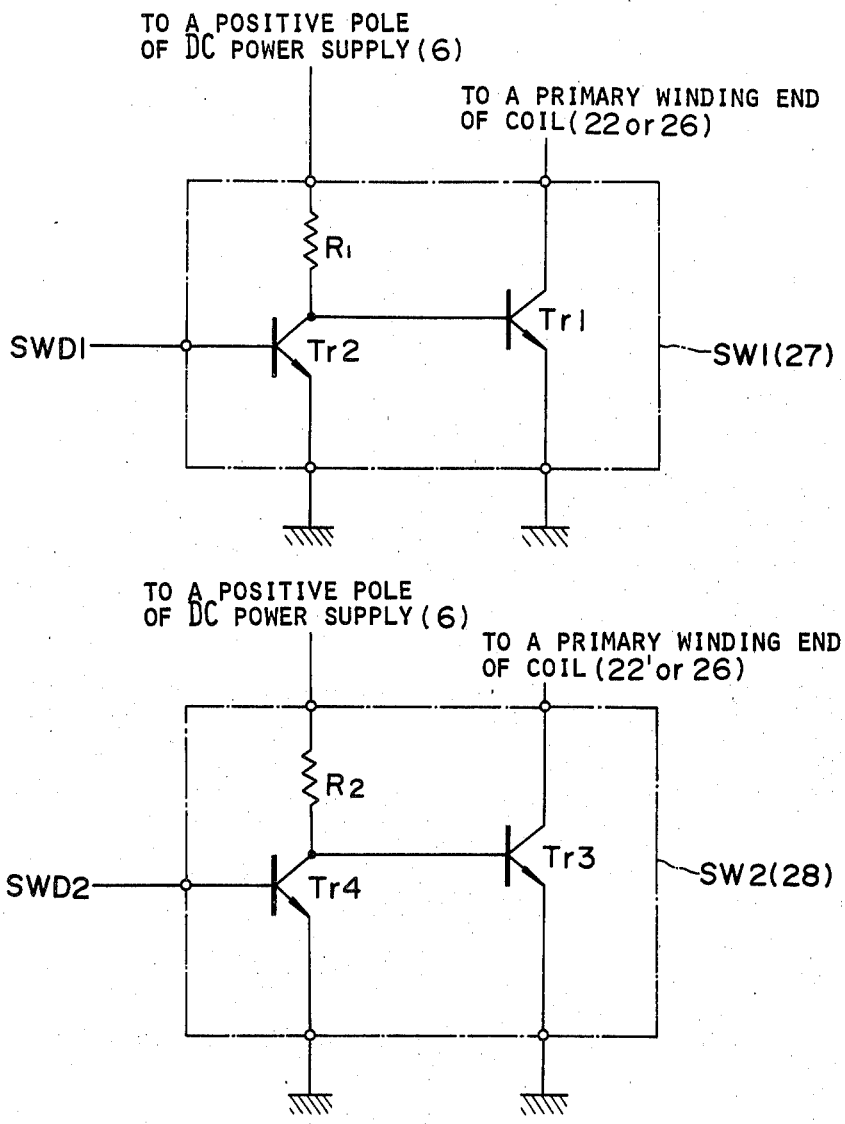
FIGS. 5(A) and 5(B) show another example of mechanical switches SW1(27) and SW2(28) seen in FIGS. 3 and 4 and an example of ignition timing signal generator, respectively.
Figure 5:
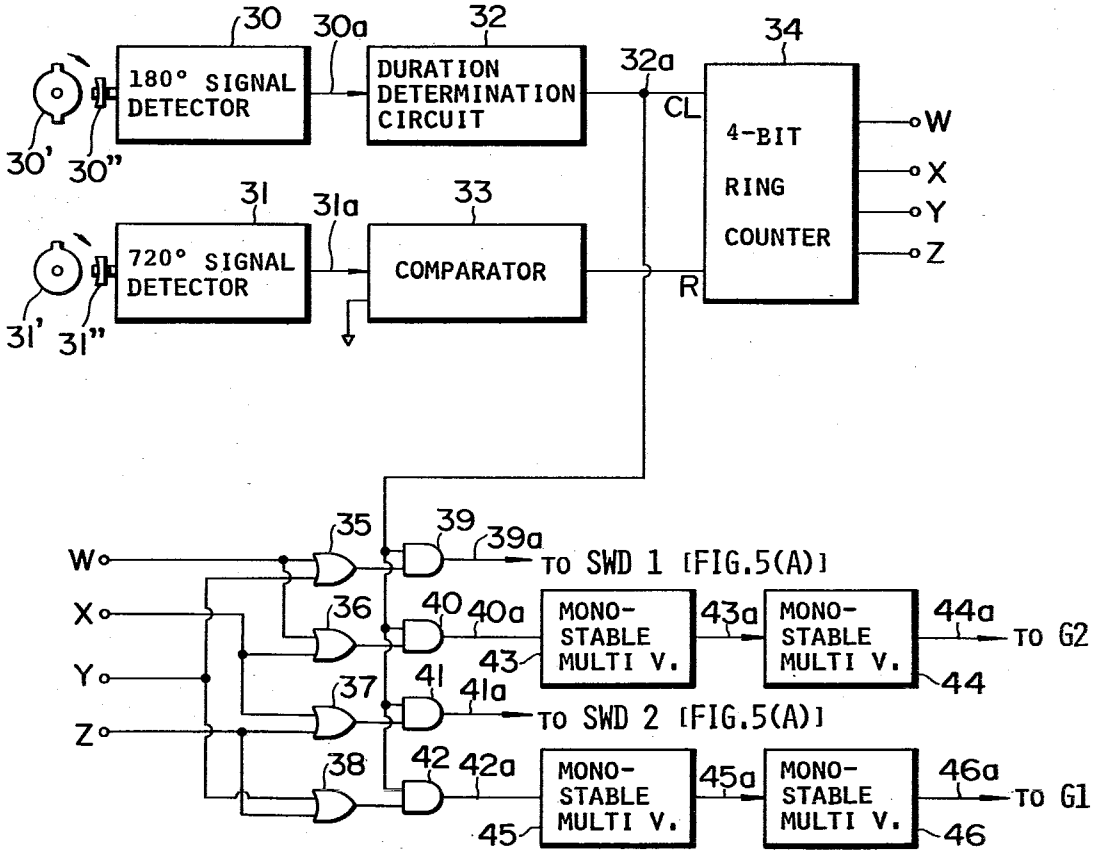

FIG. 5(A) shows alternatives to the mechanical switches SW1 and SW2. Each of the two switching circuits shown in FIG. 5(A) comprises two transistors $Tr_1$ and $Tr_2$, $Tr_3$ and $Tr_4$. The first transistor $Tr_1$ is a power transistor whose cathode terminal is connected to one end of the primary winding of the ignition coil 22 and emitter terminal is grounded. The third transistor $Tr_3$ is a power transistor of the same connection as the first transistor $Tr_1$. That is, the collector terminal thereof is connected to one end of the primary winding of the ignition coil 22' and the emitter terminal thereof is grounded.

The collector terminal of the second transistor $Tr_2$ is connected via a first resistor $R_1$ to the positive pole of the DC power supply 6 shown in FIG. 3 and to the base terminal of the first transistor $Tr_1$ and the emitter terminal thereof is grounded. The connection of the fourth transistor $Tr_4$ is the same as that of the second transistor $Tr_2$. That is, the collector terminal thereof is connected via a second resistor $R_2$ to the positive pole of the DC power supply 6 shown in FIG. 3 and to the base terminal of the third transistor $Tr_3$ and the emitter terminal thereof is grounded. It will be noted that each of the switches SW1 and SW2 is that mechanical interrupter 2 shown in FIG. 1 and both switches SW1 and SW2 open alternatingly at each instant time when the engine crankshaft rotates half revolution.

It will also be noted that since both switches SW3 and SW4 serve only to generate an AC voltage at the primary winding of the transformer 24, the frequency of switching of these switches SW3 and SW4 is not always requird to synchronize with that of the switches SW1 and SW2.

Figure 6:
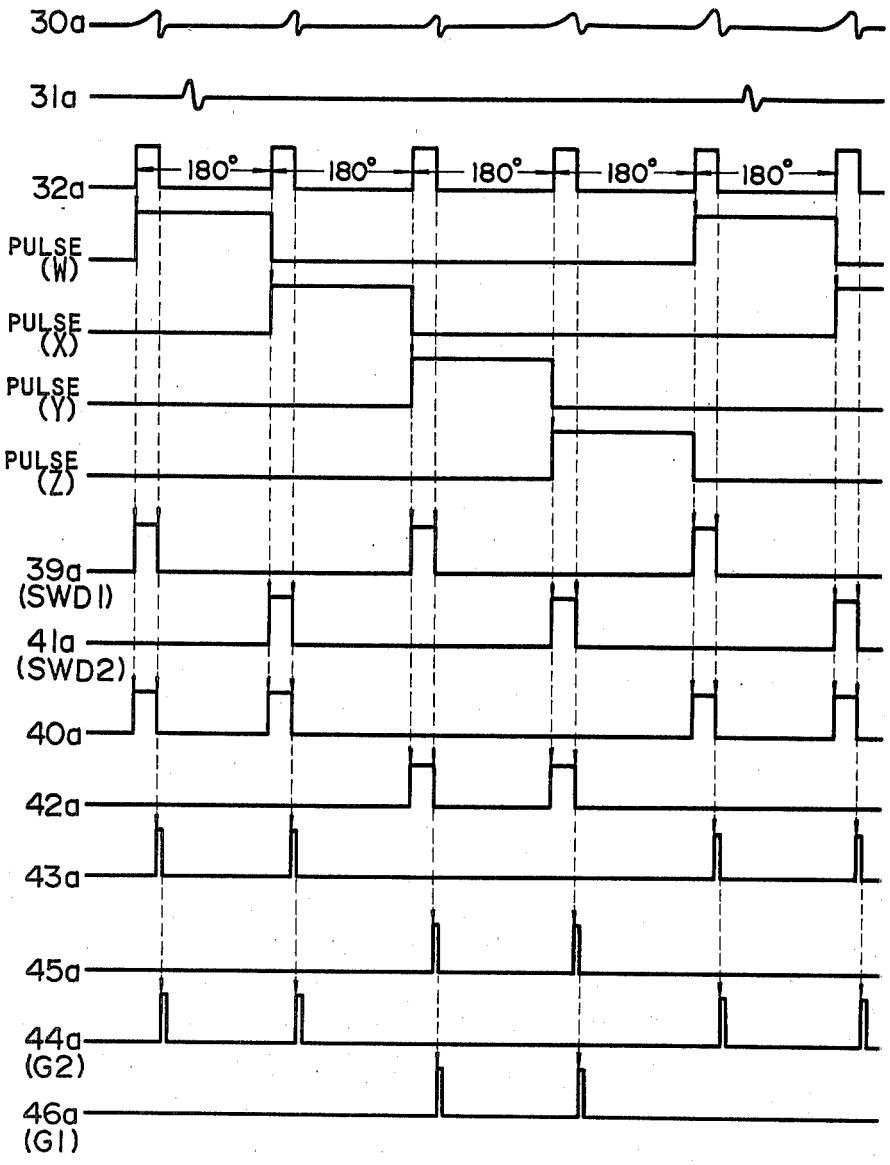
FIG. 6 shows a signal timing chart of the ignition timing signal generator shown in FIG. 5(B).

FIG. 5(B) shows an example of the ignition timing signal generator in the case of the four-cylinder engine having the four plasma ignition plugs 20, 20', 21 and 21'. Numeral 30 denotes a 180° signal detector which comprises an ignition timing disc 30' attached around the engine crankshaft having two teeth opposite to each other on the periphery thereof and an electromagnetic pick up coil 30'' which detects the passage of one of the two teeth of the ignition timing disc 30' at an interval when the crankshaft rotates half. As shown in FIG. 6 which is a timing chart of each circuit block of FIG. 5(A), the 180° signal detector 30 outputs a signal which detects a change of magnetic flux in the electromagnetic pick up coil 30''. Numeral 32 denotes a duration determination circuit comprising, e.g., comparator which detects the rising and falling edges of the output signal 30*a* from the 180° signal detector 30, exceeding a reference voltage, i.e., 0 v and outputs a pulse train 32*a* as shown in FIG. 6 so that the pulse train having a period corresponding to half rotation of the crankshaft, i.e., 180°. Numeral 31 denotes a 720° signal detector which comprises a disc 31' having a tooth on the periphery thereof attached around a shaft which rotates at one half of the crankshaft speed, e.g., a camshaft in the engine cylinder and another electromagnetic pick-up coil 31''. An output signal 31*b* from the 720° signal detector 31, shown in FIG. 6, is fed into a comparator 33 which produces a pulse train having a period equal to two rotations of the engine crankshaft, i.e., one engine cycle (720°). The comparator 33 produces a reset pulse whenever the output signal 31*b* of the 720° signal detector 31 is inputted thereto. The reset pulse is fed into a reset terminal R of a four-bit ring counter 34. The pulse train 32*a* from the duration determination circuit 32 is fed into the four-bit ring counter 34 at a clock terminal Cl thereof. As shown in FIG. 6, the four-bit ring counter 34 produces a pulse circularly at each of four output terminals W, X, Y, and Z thereof having a duration equal to one half of the crankshaft rotation. The first terminal W of the four-bit ring counter 34 is fed to one input terminal of a first OR gate 35 and one input terminal of a second OR gate 36. The second terminal X thereof is fed to the other input terminal of the second OR gate 36 and to one input terminal of a third OR gate 37. The third terminal Y thereof is fed to the other input terminal of the first OR gate 35 and to one input terminal of a fourth OR gate 38. The fourth terminal Z thereof is connected to the other input terminal of the third OR gate 37 and to the other input terminal of the fourth OR gate 38. An output terminal of the first OR gate 35 is connected to one input terminal of a first AND gate 39. An output terminal of the second OR gate 36 is connected to one input terminal of a second AND gate 40. An output terminal of the third OR gate 37 is connected to one input terminal of a third AND gate 41. An output terminal of the fourth OR gate 38 is connected to one input terminal of a fourth OR gate 42. The other input terminals of the first through fourth AND gates 39 through 42 are all connected to the output terminal of the duration determination circuit 32. An output terminal of the first AND gate 39 is connected to a drive terminal SWD1 of the switching circuit SW1 shown in FIG. 5(A). An output terminal of the second AND gate 40 is connected to a first monostable multivibrator 43. An output terminal of the third AND gate 41 is connected to an drive terminal SWD2 of the other switching circuit SW2 shown in FIG. 5(A). The first monostable multivibrator 43 is connected to a second monostable multivibrator 44 whose output terminal is connected to the gate terminal G2 of the thyristor 17 shown in FIG. 3. An output terminal of the fourth AND gate 42 is connected to a third monostable multivibrator 45 whose output terminal is connected to a fourth monostable multivibrator 46. An output terminal of the fourth monostable multivibrator 46 is connected to the gate terminal G1 of the other thyristor 16 shown in FIG. 3.

For example, when the 180° signal detector 30 detects half rotation of the disc 30' by the passage of one of the two teeth thereof, the surge voltage 30*a* shown in FIG. 6 is outputted and fed to the duration determination circuit 32. The duration determination circuit 32 then outputs the pulse train 32*a* as shown in FIG. 6. At the same time, when the 720° signal detector 31 detects one rotation of the disc 31' by the passage of the tooth thereof, the surge voltage 31*a* shown in FIG. 6 is outputted and fed to the comparator 33. The comparator 33 then outputs the other pulse train to the four-bit ring counter 34 at the reset terminal thereof only for resetting the ring counter 34 before the ring counter starts counting.

The ring counter 34 outputs a pulse having the duration equal to the 180° rotation of the engine crankshaft at one of the four output terminals W, X, Y, and Z circularly in this order at each time when the 180° pulse 32*a* is received from the duration determination circuit 32, as shown in FIG. 6. One pulse at the first terminal W as shown in FIG. 6 is fed to the first OR gate 35 and second OR gate 36. The ORed signal from the first OR gate 35 is fed to the first AND gate 39. The first AND gate outputs a pulse signal 39*a* to the drive terminal SWD1 of the switching circuit SW1 as shown in FIG. 6, taking a logical AND with the pulse 32*a* fed from the duration determination circuit 32. When the pulse signal 39*a* is fed to the drive terminal SWD1 o the switching circuit SW1 shown in FIG. 5(A), the transistor $Tr_1$ turns off instantaneously so that the secondary winding of the coil 22 shown in FIG. 3 generates a high voltage surge. At this time, the voltage surge is fed to both plasma ignition plugs 20 and 21 at each of which a spark discharge is performed within the gap thereof. One pulse at the second output terminal X is fed to the second OR gate 36. The ORed signal between the two pulses at the first and second terminals W and X is fed to the second AND gate 40. The ANDed signal 40*a* from the second AND gate 40 shown in FIG. 6 is fed to the first monostable multivibrator 43. The output signal 43*a* shown in FIG. 6 from the first monostable multivibrator 43 is further fed to the second monostable multivibrator 44 as a trigger signal. The second monostable multivibrator 44 outputs a pulse signal 44*a* shown in FIG. 6 to the gate terminal G2 of the thyristor 17 shown in FIG. 3. The thyristor 17 turns on at this time so that a circuit is formed between the diode 18, plasma ignition plug 20, thyristor 17, and capacitor 11 and the plasma ignition plug 20 performs a plasma ignition first since the resistance of the plasma ignition is already reduced due to the spark discharge.

One pulse at the second terminal X of the ring counter 34 is fed to the second OR gate 36 and to the third OR gate 37. The ORed signal from the third OR gate 37 is also fed to the third AND gate 41. The ANDed signal 41*a* shown in FIG. 6 is fed from the third AND gate 41 to the drive terminal SWD2 of the switching circuit SW2 shown in FIG. 5(A). At this time, the transistor $Tr_3$ turns off so that a high voltage surge is developed at the secondary winding of the coil 22' shown in FIG. 3 and fed to both plasma ignition plugs 20' and 21' shown in FIG. 3 via the diode 23'. Then, a spark discharge occurs at each of both plasma ignition plugs 20' and 21'. The output signal from the second OR gate 36 received from the second terminal X of the ring counter 34 shown in FIG. 5(B) is fed to the second AND gate 40. The ANDed signal 40*a* with the output signal 32*a* from the duration determination circuit 32 is fed to the first multivibrator 43. The first multivibrator outputs a second pulse signal 43*a* as shown in FIG. 6. The second multivibrator 44 outputs another second pulse signal 44*a* as shown in FIG. 6 in response to the second pulse signal 43*a* of the first multivibrator 43. The second pulse signal 44*a* is fed to the gate terminal G2 of the thyristor 17 shown in FIG. 3. Then the thyristor 17 turns on again so that a circuit is formed between the diode 18', plasma ignition plug 20', thyristor 17, and capacitor 11 and the plasma ignition plug 20' performs a plasma ignition secondly subsequent to the plasma ignition plug 20.

One pulse at the third terminal Y of the ring counter 34, shown by FIG. 6, is fed to the first OR gate 35 and to the fourth OR gate 38 as shown in FIG. 5(B). At this time, the first AND gate 39 outputs a second pulse 39*a* shown in FIG. 6 to the drive terminal SWD1 of the switching circuit SW1 shown in FIG. 5(A). The transistor $Tr_1$ turns off again (the transistor $Tr_1$ is so connected as to turn off only during the duration of the pulse fed to the drive terminal SWD1) so that a high voltage surge is developed at the secondary winding of the coil 22 as described above. Consequently, a spark discharge again occurs at both plasma ignition plugs 20 and 21 via the diode 23. The fourth AND gate 42 outputs the ANDed signal 42*a* between the 180° signal 32*a* from the duration determination circuit 32 and ORed signal from the fourth OR gate 38 by passing the pulse from the third terminal Y of the ring counter 34. The ANDed signal 42*a* is fed to the third monostable multivibrator 46. The third multivibrator 46 at this time outputs a pulse signal 46*a* to the fourth monostable multivibrator 46 as shown in FIG. 6. The fourth monostable multivibrator 46 further outputs a pulse signal 46*a* to the gate terminal G1 of the thyristor 16. The thyristor 16, at this time, turns on so that a circuit is formed between the capacitor 11, thyristor 16, plasma ignition plug 21, and diode 19 and the plasma ignition plug 21 performs plasma ignition third subsequent to the plasma ignition plug 20'. One pulse at the fourth terminal Z of the ring counter 34 shown in FIG. 6 is fed to the third and fourth OR gates 37 and 38. The third AND gate 41 then receives both the 180° signal 32*a* from the duration determination circuit 32 and ORed signal from the third OR gate 37 and outputs the ANDed signal 41*a* to the drive terminal SWD2 of the switching circuit SW2 shown in FIG. 5(A). The transistor $Tr_3$ thereof turns off again so that a high voltage surge is generated at the secondary winding of the coil 22 shown in FIG. 3. Consequently, a spark discharge occurs at both ignition plugs 20' and 21' via the diode 23'. The fourth AND gate 42 receives both the 180° signal 32*a* from the duration determination circuit 32 and ORed signal from the fourth OR gate 38 by passing the pulse from the fourth terminal Z of the ring counter 34 therethrough. As described above, the fourth monostable multivibrator 46 outputs a pulse 46*a* in a predetermined delay to the gate terminal G1 of the thyristor 16 as shown in FIG. 6.

Then the thyristor 16 shown in FIG. 3 turns on again so that the plasma ignition plug 21' performs plasma ignition fourth subsequent to the plasma ignition plug 21.

In this way, the plasma ignition occurs at the four plasma ignition plugs 20, 20', 21, and 21' circularly in this order.

It will be noted that the switching action of both switches SW3 and SW4 located at each end of the primary winding of the transformer 24 is halted during a predetermined interval is ended at each time the plasma ignition so that there is not development of AC voltage at the primary winding of the transformer 24. Therefore, after the pulse 44*a* or 46*a* from either of the second or fourth monostable multivibrator 44 or 46 is received at the gate terminal G2 or G1 and the thyristor 17 or 16 turns on, the thyristor 17 or 16 turns off.

Figure 4:
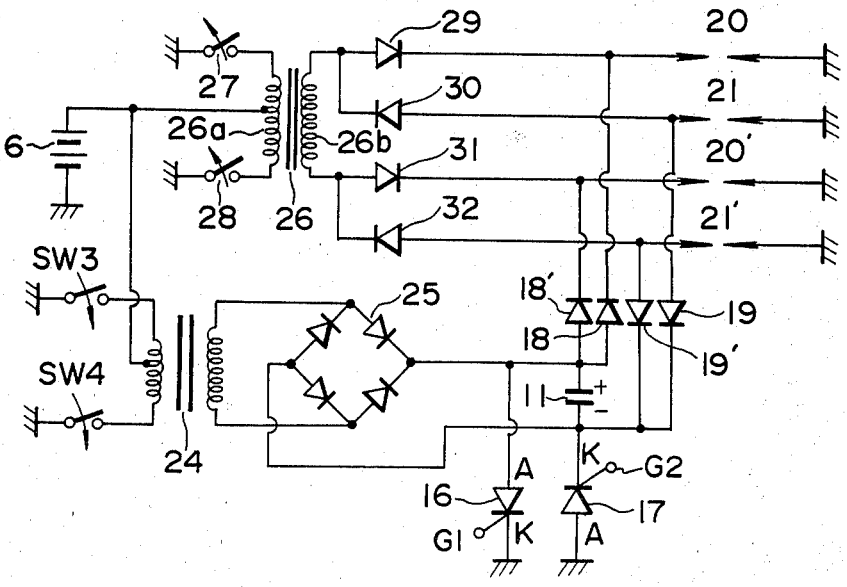
FIG. 4 is a circuit diagram showing a second preferred embodiment of the plasma ignition system according to the present invention.

FIG. 4 shows another preferred embodiment of the plasma ignition system according to the present invention. In FIG. 4, numeral 26 denotes an ignition coil to a center tap of a primary winding 26*a* connected the positive terminal of the DC power supply 6. Both ends of the primary winding 26*a* are grounded via the respective normally closed contacts 27 and 28. A secondary winding 26*b* of the ignition coil 26 is connected to the plasma ignition plugs 20 and 21 via two diodes 29 and 30 at one end thereof and connected to the other plasma ignition plugs 20' and 21' via two diodes 31 and 32 at the other end thereof. The other interconnections are the same as shown in FIG. 3.

It will be noted that contact 27 corresponds to the switch SW1 shown in FIG. 3 and switching circuit SW1 shown in FIG. 5(A) and contact 28 corresponds to the switch SW2 shown in FIG. 3 and switching circuit SW2 shown in FIG. 5(A), respectively.

When the contact 27 is opened, a positive voltage is generated at the upper end of the secondary winding 26*b*, and negative voltage is generated at the lower end of secondary winding 26*b* of the transformer 26 as viewed from FIG. 4.

To explain the whole operation of the circuit shown in FIG. 4, the contacts 27 and 28 are replaced with the switching circuits SW1 and SW2 shown in FIG. 5(A) and denoted by a switching circuit 27 and switching circuit 28, respectively. Furthermore, the gate terminal G1 of the thyristor 16 is connected to the fourth monostable multivibrator 46 and gate terminal G2 of the thyristor 17 is connected to the thyristor 17 shown in FIG. 5(B). In the circuit shown by FIG. 4, FIG. 5(A) and FIG. 5(B), the plasma ignition order is the same as in the case of FIG. 3: the plasma ignition plugs 20, 20', 21, 21' shown in FIG. 4. The detailed operation is omitted hereinafter since the operation sequence is the same as described in the first preferred embodiment.

It will be noted that the first through fourth AND gates 39 through 42 shown in FIG. 5(B) may be replaced with NAND gates. In this case, the first and third monostable multivibrators 45 and 46 need to operate upon negative going pulses inputted thereto, respec-

United States Patent [19]

Lyons

[11] 4,407,260

[45] Oct. 4, 1983

[54] ARCHERY BOWSTRING RELEASE DEVICE

[76] Inventor: Leon W. Lyons, 1122 Dewitt Ave., Niles, Mich. 49120

[21] Appl. No.: 210,121

[22] Filed: Nov. 24, 1980

Related U.S. Application Data

[62] Division of Ser. No. 62,701, Aug. 1, 1979, Pat. No. 4,282,851.

[51] Int. Cl.[3] ..... F41B 5/00

[52] U.S. Cl. ..... 124/35 A; 124/40

[58] Field of Search ..... 124/35 A, 35 R, 24 R, 124/41 A

[56] References Cited

U.S. PATENT DOCUMENTS 2,488,597 11/1949 Konold ..... 124/35 A 2,819,707 1/1958 Kayfes et al. ..... 124/35 A 4,105,011 8/1978 Chism ..... 124/35 A

*Primary Examiner*—Richard C. Pinkham

*Assistant Examiner*—William R. Browne

*Attorney, Agent, or Firm*—James D. Hall

[57] ABSTRACT

A release device for aid in drawing and quickly releasing the string of a bow to facilitate accurate launching of an arrow.

A manually shiftable member is carried by the housing of the device, and has a cam projection positioned between the legs of spring-urged string-retaining jaws. The member is pivotable between a position holding the jaws in string-retaining relation and a position permitting a spring to separate the jaws to string-releasing relation.

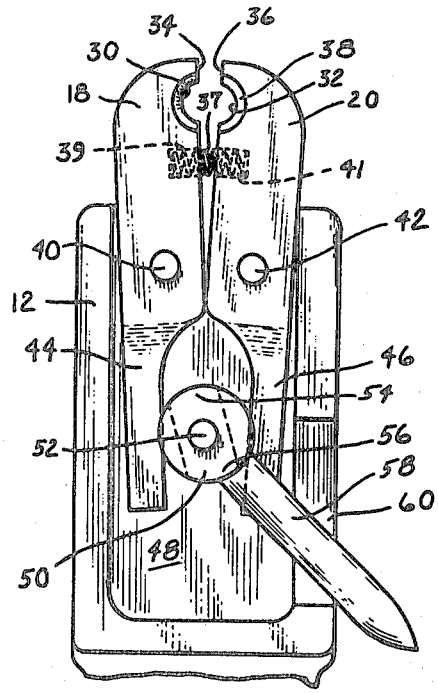

3 Claims, 9 Drawing Figures